United States Patent [19]

Djordjevic et al.

[11] 4,085,724

[45] Apr. 25, 1978

[54] FUEL REGULATOR FOR INTERNAL COMBUSTION ENGINES WITH INJECTION SYSTEM

[75] Inventors: Ilija Djordjevic, Stuttgart; Hans-Jürgen Jaenke, Ditzingen; Ernst Ritter, Stuttgart; Heinrich Staudt, Markgroningen-Talhausen, all of Germany

[73] Assignee: Robert Bosch GmbH, Stuttgart, Germany

[21] Appl. No.: 694,213

[22] Filed: Jun. 9, 1976

[30] Foreign Application Priority Data

Jun. 12, 1975 Germany ..... 2526148

[51] Int. Cl.[2] ..... F02D 1/14

[52] U.S. Cl. ..... 123/140 MC; 123/140 MP

[58] Field of Search .... 123/140 R, 140 MP, 140 MC, 123/140 FG

[56] References Cited

U.S. PATENT DOCUMENTS

| | | | |
|---|---|---|---|
| 2,758,584 | 8/1956 | Hogeman et al. | 123/140 MC |
| 3,620,199 | 11/1971 | Kohn et al. | 123/140 R |
| 3,727,598 | 4/1973 | Knapp | 123/140 MC |
| 3,830,211 | 8/1974 | Bechstein et al. | 123/140 R |

FOREIGN PATENT DOCUMENTS

| | | | |
|---|---|---|---|
| 2,224,757 | 12/1973 | Germany | 123/140 R |

*Primary Examiner*—Charles J. Myhre
*Assistant Examiner*—Tony M. Argenbright
*Attorney, Agent, or Firm*—Edwin E. Greigg

[57] ABSTRACT

The invention relates to a fuel regulator for internal combustion engines provided with a fuel injection system and with an adjusting member that operates preferably in dependence on the rpm, which moves the control rod of the fuel metering system via an intermediate lever. The intermediate lever is mounted on the pin of a bell-crank and effects an independent movement of the fuel control rod. The controller further includes a correcting device through which the position of the pin and thus the position of the fuel control rod can be changed independently and as a function of at least one operational variable, preferably the atmospheric pressure.

14 Claims, 9 Drawing Figures

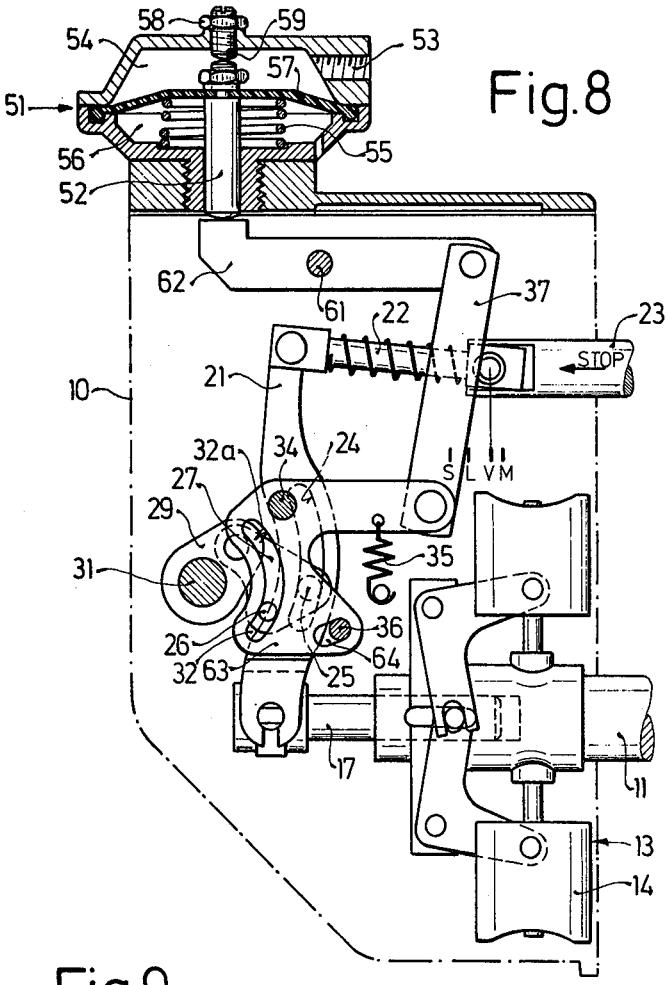
Fig.8
Fig.9
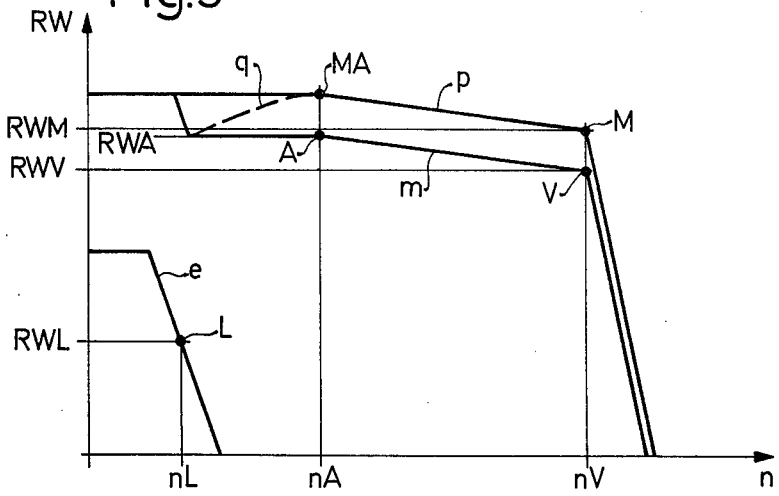

FUEL REGULATOR FOR INTERNAL COMBUSTION ENGINES WITH INJECTION SYSTEM

BACKGROUND OF THE INVENTION

Internal combustion engines with fuel injection systems, especially Diesel engines for powering motor vehicles, must often operate at various altitudes above sea-level, i.e., at variable atmospheric pressures. The injection pumps used with these engines are provided with regulators which have a quantitative full-load limitation, which is determined corresponding to the full-load or smoke limitation of the engine. In addition, these regulators are designed in many cases in such a way that the maximum quantity of fuel metered out in full-load operation can be changed over the largest possible range of rpms so that it adapts to the actual required power of the engine for smokeless combustion or for a special application. These regulators often include a correcting device for operation of the engine at very great altitudes. This device responds to the rarefied air at great heights, i.e., the lowered atmospheric pressure, and acts on the regulator in the sense of decreasing the fuel quantity injected by the fuel injection pump.

Thus, known fuel regulators of the above-described type for adaptation of the maximum quantity of fuel delivered by the fuel metering system to a changed atmospheric pressure have a correcting device, which contains a series of known diaphragm boxes and which is inserted into the linkage between the control rod and the intermediate lever of the regulator. The correcting device causes a change of position of the pin serving for the mounting of the intermediate lever depending on atmospheric pressure and thus causes a change of position of the fuel control rod. This known regulator has the disadvantage that the correcting device always carries out the same correction independently of the actual position of the adjusting member or of the control rod. Thus, both during engine idling and also in partial load operation, so much less fuel is injected that the engine will stop or will run irregularly, i.e., "buck".

Also known are governors for injection pumps which adapt the delivered fuel output to changing barometric pressure with a correcting device that engages an external lever on the control rod. A notched disc is disposed by diaphragm cells and serves as a fixed stop for the maximum deflection of the lever. This correcting device has the disadvantage of being able to carry out the necessary adjustment in height only in discrete steps. Furthermore, the position of the notched disc can be changed only whenever the lever is pulled away from the stop for deceleration, and, upon renewed acceleration, the lever will come to rest at the newly set stop position.

Further known are correcting devices which directly engage the control rod of the injection pump and limit its position thus determining the maximum fuel output. Such arrangements are disadvantageous whenever the regulators used with these injection pumps have an adapting arrangement which corrects the control sleeve path and thus the position of the control rod, so that the maximum fuel quantity for full load operation and a full load rpm is increased with decreasing rpm. The described correcting device which acts directly on the control rod only serves to decrease the maximum fuel quantity but does not take into consideration the adaptation to engine conditions so that too much fuel will be injected in the upper range of the rpm and the motor will smoke or will be overloaded.

OBJECT AND SUMMARY OF THE INVENTION

It is a principal object of the present invention to provide a fuel regulator for fuel-injected engines which performs a correction of the injected fuel as a function of the ambient atmospheric pressure and which performs this correction without affecting the fuel quantity during engine idling and without interfering with the normal rpm-dependent fuel control process provided by the known regulator in which the altitude correction is employed.

This object is attained, according to the invention, by providing that the guide pin of the adjusting link is disposed slideably in a guide track of the intermediate lever, and by providing further that a second pin, connected with the first pin, is guided in the curved track of a cam plate rotatable in the regulator housing. The pins are integral with an element articulated with the adjusting link and the rotational position of the cam plate can be changed by the correcting device connected with said plate. The rotational axis of the cam plate is disposed in such a way that, in the idling position of the adjusting link, the position of the output control rod can be changed by the correcting device from the one which obtains in the case of full load. Because the correcting device according to the invention engages the adjustment link by means of a cam plate, the reaction forces transmitted back to the correcting device will advantageously be very slight. Any existing full load fuel output control based on smoke limitation or engine torque characteristics as performed by the control element of the regulator, will remain effective over its rpm-dependent range. The rotatable cam plate makes it possible to arbitrarily decrease the influence of the correcting device in the idling position of the adjusting link as opposed to that in the full load position, even down to zero, so that, for example, the danger of the engine stoppage will be avoided when the fuel output is reduced for other reasons, e.g., in the case of a correction due to altitude.

A particularly favorable embodiment of the invention provides that the cam plate is rotatable around an axis fixed in the housing and extending parallel to the pivotal axis of the adjusting link. This embodiment further provides that the axis of the cam plate is disposed close to that end of the curved track in which the second pin of the adjusting link is in the idling position, as a result of which the desired decrease of the influence of the correcting device during idling will be achieved.

A complete or almost complete elimination of the influence of the correcting device on the idling operation of the regulator will be achieved by providing that the region of the guide track which holds the first pin during idle has a radius of curvature, the center of which lies at least approximately in the pivotal axis of the element carrying the pins.

A preferred embodiment of the object of the invention is such, that the curved path of the cam plate has the form of a circular arc, the center of which coincides in the starting position of the cam plate (effecting no correction) with the center of the axis of the operating lever of the adjusting link which is rotatable for the arbitrary movement of the output control member. As a result, the adjusting link, despite the additional bell crank element, acts like the often used lever-shaped guide which provides a fixed distance between the center of the axis of the operating lever shaft and the pin engaging at the intermediate lever. Furthermore, it will be advantageous if the cam plate is kept in its starting position by a return spring which urges it against a stop fixed in the housing, thereby defining this position unequivocally.

A known centrifugal rpm governor for internal combustion engines with fuel injection systems provides that part of the pin of the adjusting link is disposed slideably in a guide track of the link, while another part of the pin is guided in the curved track of a cam plate which rotates in the governor housing. The pin is connected pivotably with the adjusting link, and the cam plate is held by a spring in its starting position against a stop fixed in the housing. However, in this centrifugal rpm regulator, the rotatable cam plate only has the function of energy storage and nowhere in the regulator does a correcting device operate in dependence on operational engine variables. The rotatable cam plate of this regulator has thus a completely different purpose and effect.

Two embodiments of the object of the invention are shown in the drawing and will be described in more detail in the following paragraphs.

BRIEF DESCRIPTION OF THE DRAWING

FIG. 8 is a simplified illustration of a second embodiment, similar to that of FIG. 4, but for a centrifugal force rpm regulator with a correcting device operating in dependence on the induction tube pressure; and FIG. 9 is a diagram showing characteristic operating curves of the regulator according to FIG. 8.

DESCRIPTION OF THE PREFERRED EMBODIMENT

Figure 1:
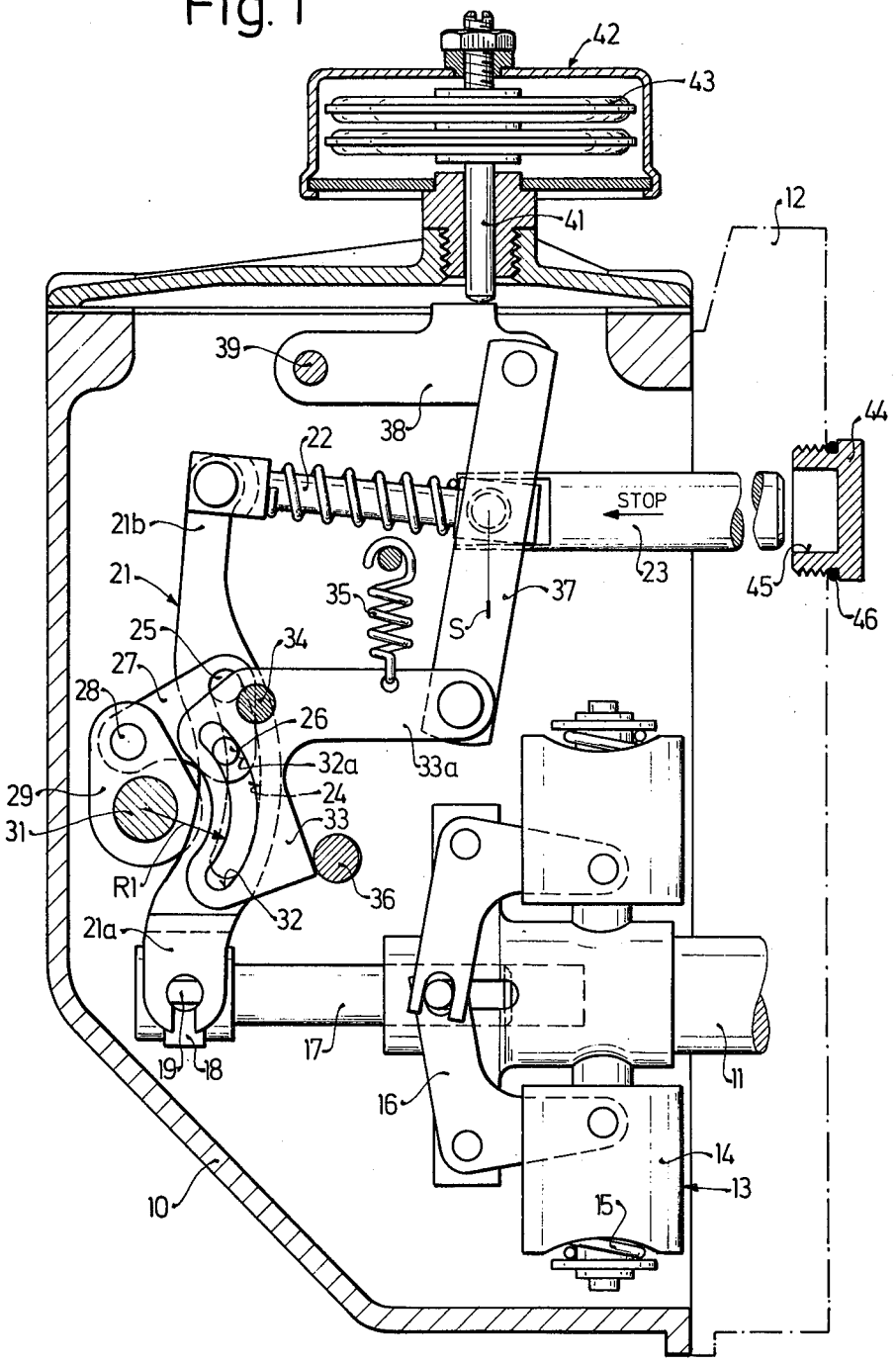
FIG. 1 shows a cross section through the first embodiment of a centrifugal rpm regulator according to the invention limited to essentials.

Turning now to the first embodiment of this invention in FIG. 1, there is shown a centrifugal force speed governor 13 provided in a housing 10 which is in turn mounted on a schematically illustrated fuel injection pump. 12. The governor is driven by the shaft 11 which extends from the fuel injection pump. The centrifugal force speed governor is of the type shown in the Kuhn et al. U.S. Pat. No. 3,620,199 which is also owned by the assignee of this application, said governor including fly-weights 14 and springs 15. The bell crank levers 16 of the governor are associated with a control sleeve 17 and the latter engages a slide ring 18, said slide ring being connected to an elongated lever 21 through the medium of an element 19. The elongated lever 21 has a lower portion 21*a* coupled with the slide ring 18 and an upper portion 21*b* which is pivotally attached to a link 22 that is in turn associated with the fuel quantity control rod 23 of the fuel injection pump 12. The elongated lever 21 has an intermediate curved zone which is slotted as at 24, the slot following the general curved zone of the lever.

Figure 3:
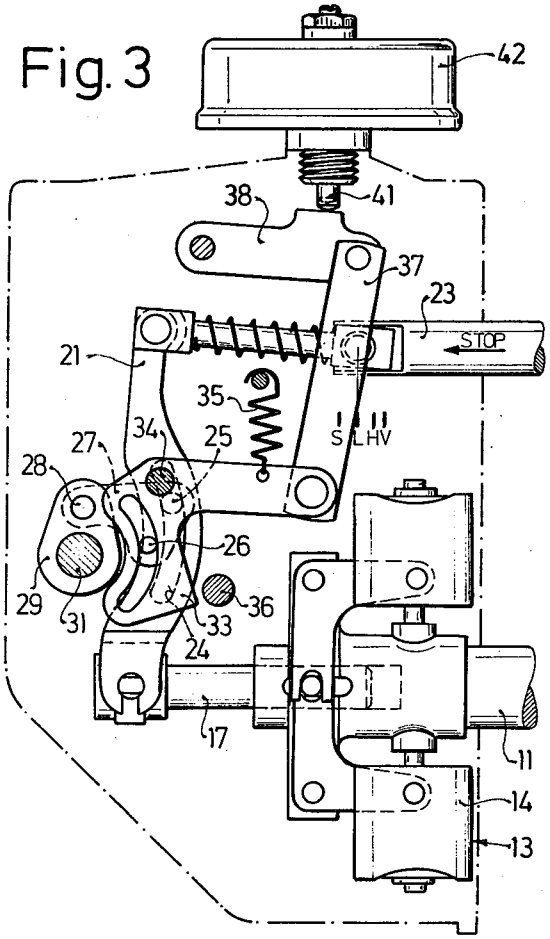
FIG. 3 shows a simplified presentation of the first embodiment with structural elements in their idling position with actuation of the cam plate by a high altitude stop.
Figure 2:
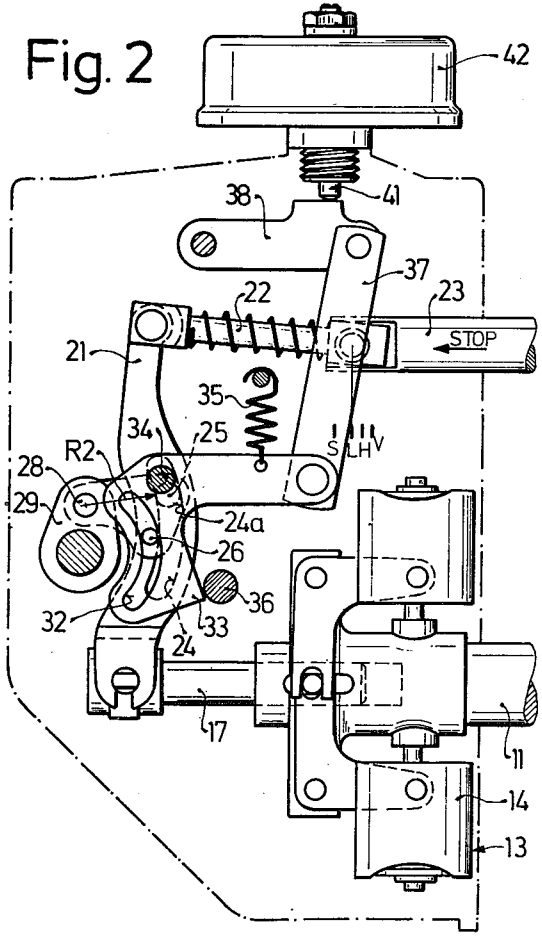
FIG. 2 shows a simplified presentation of the first embodiment with structural elements in their idling position without actuation of the cam plate by a high altitude stop.

By further reference to FIG. 1, at this time it will be observed tgat link 29 provided with a pivot element 28 is rotatably supported in the housing 10 on a movable shaft 31, said pivot element 28 being associated with an element 27 that includes a pair of offstanding protuberances 25 and 26, the first of which is positioned to travel in the curved slot 24 of the lever 21 while the second protuberance is arranged to follow a generally similarly curved track 32 provided in a cam plate 33 which swivels about a shaft 34 positioned in the housing 10. The axis of shaft 34 is parallel with shaft 31. In known manner, there is attached to the shaft 31, exteriorly of the housing 10, an operating lever (not shown) which permits an arbitrary setting of the link 29 and hence of the control rod 23, independently of the automatic regulator mechanism. The shaft 34 is located near that end of the curved track 32 (designated by 32*a* in FIGS. 1 and 2) in which the second pin 26 of the adjusting link 29 is in the idling position. The "idling" position of the various parts of the regulator is illustrated in FIGS. 2 and 3 and will be described further on in more detail in regard to these figures. In FIG. 1, however, all the elements of the regulator are illustrated in the "Stop" position, i.e., when the drive shaft 11 is not rotating; the corresponding position of the control rod 23 relative to the housing is designated by S.

The cam plate 33 is maintained in its starting position shown in FIG. 1 and held against a stop 36 fixed in the housing. A lever-like extension 33*a* of the cam plate 33 is associated by way of a tab 37 with a lever 38, the free end of which is pivotally mounted on pin 39 fixed in the regulator housing 10, said lever 38 being operated by a pressure pin 41 which is part of a correcting device 42 operating in dependence on the barometric pressure. This altitude correcting device 42 includes diaphragm cells 43 which expand at higher altitudes because of the lower atmospheric pressure prevailing there and thus rotate the cam plate 33 in a clockwise direction via the pin 41, the lever 38 and the tab 37, as a result of which—as shall be explained further on in relation to FIG. 5—a correction of the fuel output of the fuel injection pump 12, controlled by the control rod 23, will take place when the adjusting link 29 is in the full-load position.

The curved track 32 provided in the cam plate 33 has the shape of a circular arc. In the starting positions shown in FIGS. 1, 2 and 4, the radius R1 of the circular arc has its approximate center in the center of the steering lever shaft 31 which serves as a pivotal axis for the link 29. Thus, in this position the link 29 provided with the element 27 would operate like a known non-accentric fixed lever, for which event the distances between the movable shaft 31 and the protuberances 25 and 26 always remain the same. However, it is to be understood that the track 32 can also have a different shape, if necessary.

The region 24*a* of the track 24 provided in lever 21 has an inner radius of curvature R2 (see FIG. 2), whose center lies in the middle of the pivot element 28 serving as an axis of rotation for the bell crank element 27. This position of the center of the radius of curvature R2 has the effect that, in the idling position of the link 29 and of the centrifugal governor 13 with its control sleeve 17, no change of position of the lever 21 occurs even in the event of rotation of the cam plate 33 and thus there is no change of the position of the control rod 23 and hence no change of injected fuel output at idling.

On the basis of the positions of the pivoting points selected in this embodiment of the invention and of the lever arm ratios of the lever 21, two protuberances 25 and 26 are disposed on the element 27. However, by making suitable changes of the track 24, the separate protuberance 26 could be omitted and a part of the other protuberance 25, which could be made to project into the track 32, take over its function. This variation of the embodiment discussed can be achieved by simple constructional measures, and for that reason it is not shown.

The reciprocal movement of the control rod 23 is limited by a stop 44 provided in a hollow screw. As is already known, the path of the control rod can be adjusted by the means of the recess 45 which may be of varying depth or by means of washers 46 of varying thickness or else by some other known adjusting means.

Figure 5:
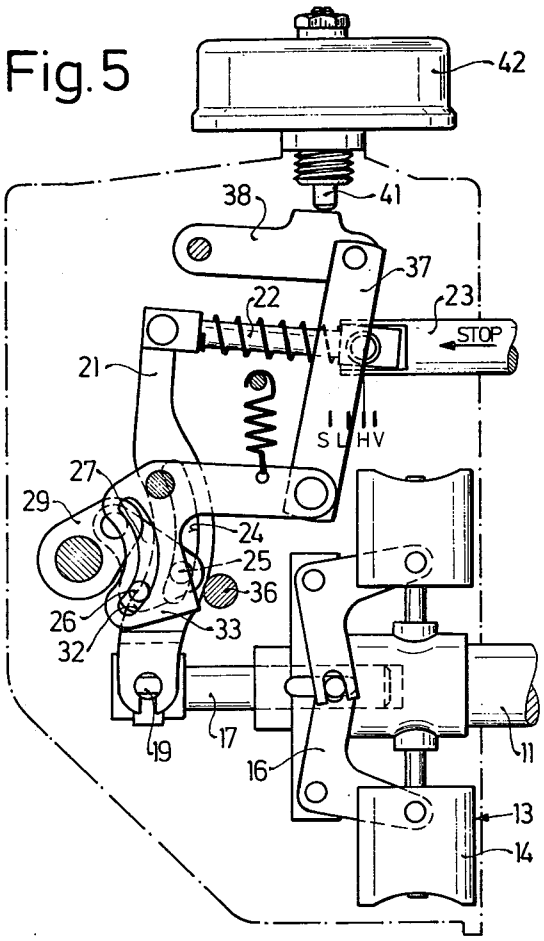
FIGS. 4 and 5 show the embodiments of FIGS. 2 and 3 with the structural elements in full-load position.

FIGS. 2 and 5 are simplified reduced scale diagrams showing the first embodiment of the centrifugal force speed governor shown in FIG. 1 with the correcting device 42 operating in dependence on the barometric atmospheric pressure in four operating positions (SLHV), which are essential for the explanation of the invention.

In FIGS. 2 and 3, the link 29 with the element 27 and the offstanding protuberances 25 and 26, provided thereon, is shown in the idling position as set by the operator, with the weights 14 of the centrifugal governor 13 as well as the control sleeve 17 being shown in the position which they assume in the case of an engine running at an idling rpm.

Also in FIG. 2, the cam plate 33 is shown in its starting position in which it is held against the stop 36 by the return spring 35. The cam plate 33 maintains this position while the correcting device 42 does not carry out any adjusting or movement, which is the case, for example, in an internal combustion engine operating approximately at sea level. On the basis of the fixed dimensions of the parts of the regulator, the control rod 23 will then be in the idling position characterized by L.

In FIG. 3, the cam plate 33 has been rotated clockwise about the axis 34 by the pressure pin 41 of the correcting device 42 through the lever 38 and the tab 37, away from the stop 36 into the position as shown. At the same time, the element 27 has rotated slightly in the clockwise direction because of the curved path 32, while the link 29 remained stationary.

Thus, the protuberances 25 and 26 of element 27 will likwise be slightly farther from the axis of rotation 34. At the same time, however, the position of the control rod 23, as can be seen from FIG. 3, has not changed from the position shown in FIG. 2, but it continues to remain in its idling position designated by L, because in this case, in which no correction of the idling position of the regulator is to be made, the radius of curvature R2 in the region 24*a* of the track 24 (see FIG. 2) has its center point precisely on the axis of the pivot element 28 which serves as an axis for the element 27. In FIG. 3, the present position of the pressure pin 41 of the correcting device 42, which was originally shown in FIG. 2, is now shown in dash-dot lines. The pressure pin 41 will assume the position drawn in solid lines, for example, whenever the regulator operates at a level of 2000 meter, as is the case, for instance, whenever a vehicle equipped with such a regulator crosses a mountain pass. In FIGS. 2–5 additional line markings are shown: the stop position is designated by S, the full-load position is designated with V, the position of the control rod 23 for the case of full-load operation at great altitudes, is marked H and the idling position is designated by L. The direction of motion of the control rod 23 toward engine stop has been characterized by an arrow and the addition of the word "Stop".

Figure 4:
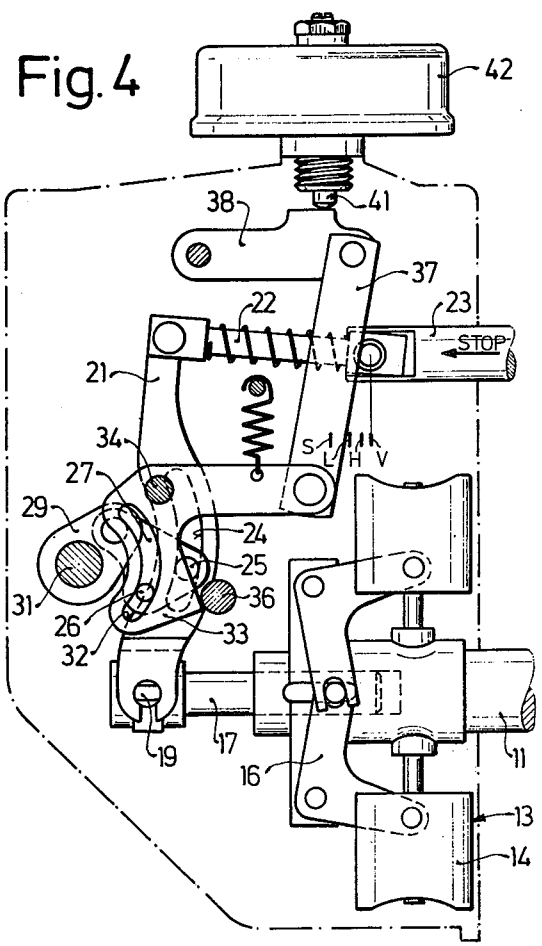

In FIGS. 4–5, the positions of the cam plate 33 and the pressure pin 41 of the correcting device 42 are exactly the same as in FIGS. 2 and 3; however, the remaining regulator parts are in positions which they assume during full-load operation of the regulator. Thus, the weights 14 of the centrifugal governor 13, due to greater centrifugal force, are at a distance spaced farther away from the drive shaft 11 and the arms 16 have pulled the control sleeve 17 farther into the centrifugal governor 13, as a result the bearing pin 19 of the lever 21 has also moved from the position shown in FIGS. 2 and 3 to the right in the plane of the drawing. The link 29 has been farther rotated by the operator out of the idling position shown in FIGS. 2 and 3 in the clockwise direction to the full-load position drawn in FIGS. 4 and 5; as a result of the guidance in the curved track 32 of the cam plate 33, the protuberance 26 has assumed a position further removed from the pivotal axis 34. Correspondingly, the position of the protuberance 25 has also changed as has the position of the lever 21, guided thereon by the track 24 and with it the control rod 23.

In FIG. 4, the regulator operates at sea level and the position of the cam plate 33 is the same as in FIG. 2, while the control rod 23 is in the full-load position designated by V.

In FIG. 5, the cam plate 33 has been pivoted by the pressure pin 41 of the correcting device 42 due to an altitude correction as in FIG. 3, whereby, as a result of the shifting of the curved track 32, element 27 is rotated in relation to the movable shaft 31 in such a way that the protuberances 25 and 26 will have moved to the left, i.e., toward the shaft 31. At the same time, the protuberance 25 has swiveled the lever 21 counterclockwise by way of the slotted track 24 because of the fixed bearing pin 19, and the lever 21 has pulled the control rod 23 from the previous full-load position shown in FIG. 4 into the corrected full-load position designated by H shown in FIG. 5. This function is achieved partly by reason of the fact that only the region 24*a* (see FIG. 2) has the radius of curvature R2, while the remaining region of track 24 has a considerably larger radius or it can even have a straight course.

Figure 6:
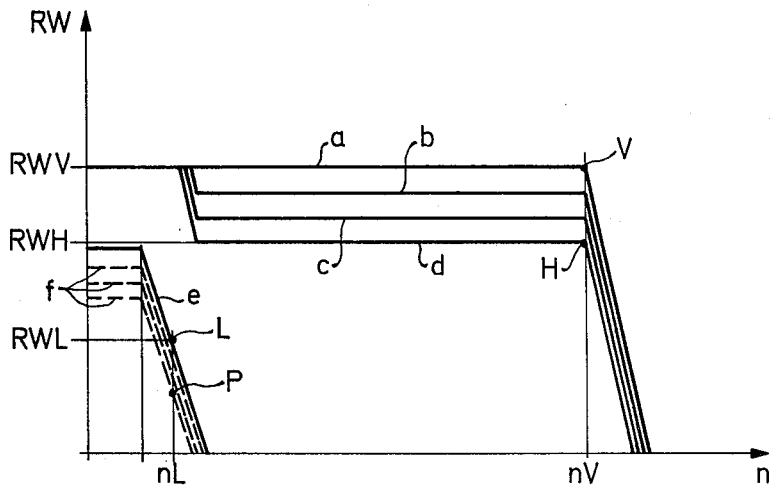
FIGS. 6 and 7 is a diagram of characteristic operating curves for the embodiments according to the FIGS. 1-5.
Figure 7:
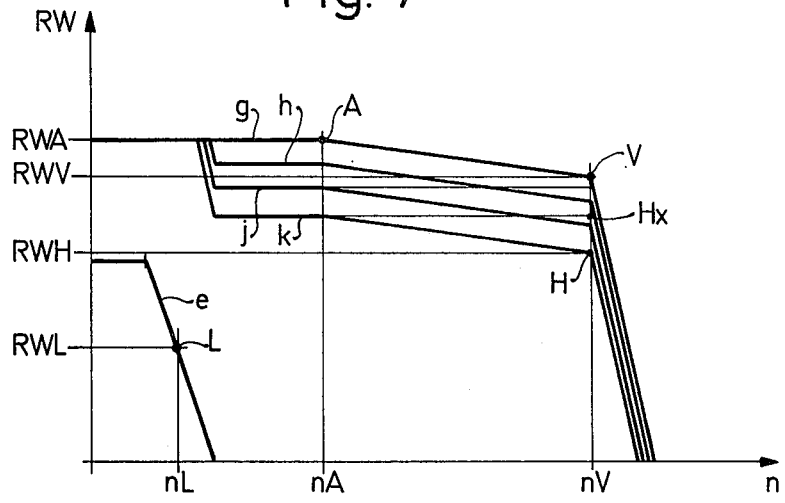

The diagrams of FIGS. 6 and 7 serve for the explanation of the operation of the first embodiment depicted in FIGS. 1–5. The control curves shown here display the path RW traveled by the control rod 23 as a function of the engine speed *n*. The control path for the full-load point V is designated by RWV and the associated rotational speed is designated by *n*V. The curve *a* passing through the point V is valid for standard operation of the regulator at sea level, that is to say at zero meters elevation. The curves *b*, *c*, and *d* represent, respectively, corrected full-load curves for operation of the regulator at 1000, 2000 and 3000 meters above sea level, and the point H in the curve *d* corresponds to the position of the control rod 23 of the first embodiment as shown in FIG. 5, with the pertinent control path RWH at the rotational speed *n*V. The idling control curve is designated by *e* and the point assumed by the control rod 23 in its idling position at the rotational speed *n*L and on the control path RWL is designated with L. The curves *f* shown as a broken line below the idling curve *e* represent idling control curves for the regulator, which does not incorporate the present invention and wherein the correction for high altitude is also effective in the idling range. Thus, during a correction for altitude from the full-load curve *a* to the corrected full-load curve *a* to the corrected full-load curve *b*, the curve *e* would, at the same time, be transferred to the curve *f* with the idling point P, (the lowest broken line), which means that when the engine runs at the idling speed *n*L, it obtains too little fuel and will stop. The parts of the curves *b*, *c* and *d* near the idling speed *n*L, which are shown to rise in the direction of the curve *a*, are generated as a result of the fact that, in the case of a decrease in speed, the idling springs of the centrifugal governor 13 will urge the weights 14 inwardly in the direction of the drive shaft 11 and thus will shift the control rod 23 toward a larger quantity (fuel-mass) via the control sleeve 17 and the elongated lever 21, until the control rod 23 abuts against the fixed stop 44 as can be seen in FIG. 1. The curves *a–d* extend horizontally up to the speed *n*V in the case of a regulator without any adapting mechanism. However, whenever the centrifugal speed governor does include an adapter mechanism, for example for adapting the regulator to obey a given smoke limit or torque characteristic of the engine, then the full-load control curves *a–d* in FIG. 6 change into the full-load curves labeled *g*, *h*, *j* and *k*, in FIG. 7. The full-load points V and H at the rotational speed *n*V are the same as those in FIG. 6, but the curves *g–k* rise with decreasing rotational speed up to the adaptation speed *n*A and extend horizontally only thereafter. Thus, the full-load curve *g* viewed from the full-load point V rises up to a point A when the adapting speed is *n*A and extends horizontally only thereafter. The idling control curve *e* corresponds to that in FIG. 6. The continuation of the control curves *h*, *j* and *k* effective in the case of a correction for altitude and drawn in a broken line, show the control curves as they would look if, instead of the correcting device 42 acting on the cam plate 33, a correcting device acting directly on the control rod 23 would be used, which in correspondence with the changed altitude shifts a stop for the maximum position of the control rod 23. In such a case, for example for the curve *k*, no adaptation would take place between the rotational speeds *n*A and *n*V, so that the control rod would be moved back from the point V only down to the point H*x* and not to the point H. As a result, the internal combustion engine would be fed too much fuel and would develop excessive smoke. If an altitude stop acting directly on the control rod were to become effective at the point V instead of point A, then the fuel quantity would actually be reduced to the quantity corresponding to the point H but in that case, there would be no adaptation at all and the control curves would extend as in FIG. 6, i.e., the required increase in torque for lower rotational speeds would not be provided.

A centrifugal force speed governor suitable for the use of the invention and shown in a simplified manner in FIGS. 1–5 and 8, is the idling and maximum speed governor of the type RQ made by the firm Robert Bosch GmbH, Stuttgart (see for example, Pamphlet VDT-UBP 211/3), and the sets of springs contained in the weights 14 of the centrifugal governor 13 can be made in known manner with or without provision for an adapter, so that the control curves shown in FIG. 6 or those in FIGS. 7 and 9 may be obtained, respectively.

As contrasted with the correcting device 42 operating in dependence on the altitude, a second embodiment of the invention is shown in FIG. 8 and includes a correcting device 51 which operates in dependence on the boost pressure of a Diesel engine equipped with an exhaust turbo-charger, positioned in the intake pipe of the engine. The boost pressure prevailing in the induction tube is fed through a conduit (not shown) to a pipe connection 53 of a compression chamber 54. The chamber 54 is separated by a pressure-tight diaphragm 57 from a second chamber 56 containing a return spring 55 and vented to the atmosphere as shown. The starting position of the pressure pin 52 of the correcting device 51, as shown, is controllable by means of an adjusting screw 59 which may be locked by a nut 58; this starting position is assumed in the case of unaided suction operation of the engine, i.e., without pressure boosting by the exhaust gas turbo-charger. All regulator elements of FIG. 8 are shown in the positions which they assume during full-load operation of the engine but without any induction pressure boost just as shown in FIG. 4 for the first embodiment of the invention. All the regulator parts which are the same as in the first embodiment retain the same reference numberals.

As in FIG. 4, the control rod 23 is in its full-load position, designated by V; likewise the adjusting link 29 and the weights 14 of the centrifugal governor 13 have assumed positions corresponding to the full-load rotational speed of the drive shaft 11, as in FIG. 4, as have the control sleeve 17 and the lever 21.

The adjusting movements of the pressure pin 52 are transmitted by way of a pivotable lever 62, mounted on a bolt 61 fixed in the housing and via the tab 37, to a cam plate 63 which can be rotated around an axis 34. This cam plate differs from the cam plate 33 of the first embodiment merely in that the return spring 35 and the stop 36 are in different positions. The track 32 is the same as in the case of the first embodiment, however, the cam plate 63 in the present embodiment is pressed against the stop 36 in a clockwise direction by the reversal of action of the return spring 35. Therefore, an adjusting movement of the correcting device 51, transmitted by the pressure pin 52 via the lever 62 and the tab 37, would rotate the cam plate 63 counter-clockwise around its pivotal axis 34, so that, with the control sleeve 17 stationary, the control rod 23 would be moved by the lever 21, via the protuberances 26 and 25 of the element 27 into a position M for an additional fuel quantity, beyond the full-load position V. The rotary movement of the cam plate 63 just described is made possible as a result of an oblong slot 64, one inside edge of which abuts against the stop 36 in the position shown in FIG. 8 and moves away from it when the cam plate 63 rotates. The track 24 in the intermediate lever is the same as in the case of the first embodiment, so that, even though the correction of the full-load output depends on the boost pressure in this embodiment, the idling control curve is also unaffected.

FIG. 9 shows the control curves for the second embodiment of the invention according to FIG. 8. The idling control curve *e* with the idling point L and associated idling speed *n*L, as well as the pertinent control path RWL are all substantially the same as in FIGS. 6 and 7 of the first embodiment of this invention. The full-load control curve with the points A and V is designated by *m* and the curve containing the point M for the added quantity controlled by the correcting device 51 is designated by *p*. The point of the curve *p* corresponding to point A at the rotational speed *n*A is designated by MA. The curve *m* corresponds substantially to the curve *g* in FIG. 7; however there is a rise to the highest control point in the vicinity of the idling rotational speed *n*L, similarly as in the case of the curves *h, j* and *k* in FIG. 7.

As can be seen from a comparison of curves *p* and *m* of FIG. 9, the fuel adaptation between the rotational speeds *n*A and *n*V is maintained even when the additional fuel quantity M is added. The curve *p* is shown simplified for a constant maximum boost pressure. However, in practice, the boost pressure produced by an exhaust gas turbo-charger will drop with low rotational engine speeds, so that, instead of the horizontal course of the curve *p*, a so-called "negative adaptation", i.e., a decrease of the injected fuel quantity takes place below the rotational speed *n*A, as is indicated in FIG. 9 by the curved part *q*, shown with a broken line.

The overall operation of the invention will now be discussed in conjunction with the figures. When the engine as well as the drive shaft 11 are stopped and the link 29 is pulled back into the stop position and while the correcting device 42 including the cam plate 33 is in its initial position, all regulator elements occupy "stop" positions as shown for the first embodiment in FIG. 1.

If now the link 29 is rotated into the idling position and the drive shaft 11 rotates at the idling speed of the engine, then the regulator elements assume the positions shown in FIG. 2 and the control rod 23 is in the position designated by L. During operation at high altitudes, the correcting device 42 will rotate the cam plate 33 into the position shown in FIG. 3, and, as has already been explained earlier herein, no change of the position of the control rod 23 will occur.

Whenever the link 29 is rotated into its full-load position and the drive shaft 11 rotates at full-load rotational speed *n*V, then the regulator elements assume the positions shown in FIG. 4 and the control rod 23 will be in the position designated by V. In the event of a correction for altitude by the device 42, the cam plate 33 is rotated into the position shown in FIG. 5, as has already been described earlier and the control rod 23 is retracted into the position designated by H. (See in this respect also FIGS. 6 and 7). Any concurrent control effort by the centrifugal governor 13 will remain effective in this case, as can be seen from FIG. 7.

In the event of a correction dependent on the manifold boost pressure, as disclosed in the second embodiment of the invention, a correcting movement of the control rod 23, acting in the reverse direction, will take place from the full-load point V in the direction of the point M thereby controlling the added fuel output as has already been explained with reference to FIGS. 8 and 9. Here too, an adjustment of the fuel quantity between the rotational speeds *n*A and *n*V is maintained, under the control of the centrifugal governor 13 (see FIG. 9).

A correction in the sense of a larger injected fuel quantity, for example, a correction dependent on the induction tube pressure as in the second embodiment according to FIGS. 8 and 9, can also be made with the mechanism according to FIGS. 1 to 5, if the cam plate 33 is in the position shown in FIGS. 3 or 5 during unboosted operation and in the position shown in FIGS. 1, 2 or 4 during turbo-charging. The lever 38 can also be used if the reversal of motion takes place within the correcting device itself. Furthermore, the tab 37 may be pivoted directly on the pressure pin 41 of the correcting device 42 or the pressure pin 52 of the correcting device 51. In lieu of either the correcting devices 42 or 51, other types of correcting devices, dependent on other operational variables, such as a heat sensor (wax cartridge) controlled by the temperature of the exhaust gas which could function as an overall protective medium or even manually controlled stops for added or decreased fuel quantities can cause actuation of the cam plate 33 (FIGS. 1–5) or 63 (FIG. 8).

What is claimed is:

1. In a regulator for the fuel supply system of a fuel-injected internal combustion engine, said regulator including a housing containing: an rpm-dependent governor member; part of a fuel quantity control member of the fuel supply system; an intermediate lever, with the governor member being linked by the intermediate lever to the fuel quantity control member; an actuating member; and a pin, with said intermediate lever being pivoted on the pin and attached thereby to the actuating member, and further including a correcting device, mounted to the housing and coupled to said pin to change the position thereof independently of said actuating member to thereby also change the position of said fuel quantity control member, the improvement comprising:

said intermediate lever being provided with a slotted track within which said pin moves;

a bell crank element, pivotably connected to and forming part of said actuating member and fixedly carrying said pin and a further pin; and a cam-plate, pivotably attached to said housing and provided with a cam-track in which said further pin moves, and pivotably connected to said correcting device, whereby the pivotal axis of said cam-plate is disposed in the housing such that, in an idling position of said actuating member a lesser or greater correction of the position of the fuel quantity control member is controllable by said correcting device than in a full-load position of said actuating member.

2. A regulator as defined by claim 1, further including a first shaft and a second shaft, wherein said actuating member pivots about the first shaft in said housing and wherein said cam-plate pivots about the second shaft in said housing parallel to said first shaft and wherein said first and second shafts are so disposed that said second shaft is adjacent to that end of the cam-track in which resides said second pin in said idling position of said actuating member.

3. A regulator as defined by claim 2, wherein the region of said slotted track in which said pin resides in the idling position of said actuating member has a radius of curvature whose center is located approximately within the center of attachment of said bell crank element to said actuating member.

4. A regulator as defined by claim 2, wherein the cam-track of the cam-plate defines a circular arc whose center coincides with the center of said first shaft of said actuating member when said cam-plate is located in its initial position in which said correcting device has no effect on said fuel quantity control member.

5. A regulator as defined by claim 1, further including a stop affixed to the housing, and a return spring, wherein said cam-plate is retained in its initial position by a return spring associated with the stop.

6. In a regulator as defined by claim 1, wherein said fuel quantity control member includes a pressure sensitive element.

7. In a regulator as defined by claim 6, wherein said pressure sensitive element includes diaphragm cell means.

8. In a regulator as defined by claim 7, wherein said diaphragm cell means includes pressure pin means arranged for cooperation with said cam plate.

9. In a regulator as defined by claim 1, wherein the correcting device comprises barometric pressure element means which includes a compression chamber, a diaphragm means in said chamber, means defining an opening in said chamber on one side of said diaphragm means arranged to receive boost pressure from the engine and vent means on the other side of said diaphragm means open to atmosphere.

10. In a regulator as defined by claim 1, further including a stop member, and wherein the cam plate includes an abutment means arranged to cooperate with the stop member.

11. In a regulator as defined by claim 1, further including stop means, and wherein the cam plate further includes an additional slotted area arranged to cooperate with the stop means that extends through said additional slotted area.

12. In a regulator as defined by claim 1, further including return spring means, and support means, and wherein said return spring means is associated with a lever-like extension provided on said cam plate and is positively secured to a support means positioned on the regulator housing.

13. In a regulator as defined by claim 1, wherein said fuel quantity control member changes the position of the cam plate due to induction tube pressure of the engine.

14. In a regulator as defined by claim 1, wherein said fuel quantity control member means changes the position of the cam plate due to ambient atmosphere pressure.

* * * * *